United States Patent [19]

Morane

[11] 3,949,911

[45] Apr. 13, 1976

[54] PRESSURIZABLE CONTAINER BY HEAT ACTIVATION

[75] Inventor: Bruno P. Morane, Paris, France

[73] Assignee: Societe Anonyme dite: L'Oreal, Paris, France

[22] Filed: May 6, 1974

[21] Appl. No.: 467,293

[30] Foreign Application Priority Data

May 7, 1973 France ..... 73.16344

[52] U.S. Cl. ..... 222/386.5; 222/394

[51] Int. Cl.[2] ..... B65D 83/14

[58] Field of Search . 206/219; 222/95, 54, 146 HA, 222/386.5, 394, 399, 211; 169/26, 27, 28, 85, 86, 87

[56] References Cited

UNITED STATES PATENTS

| | | | |
|---|---|---|---|
| 2,815,152 | 12/1957 | Mills | 222/386.5 |
| 2,857,971 | 10/1958 | Ferris | 169/26 |
| 3,023,750 | 3/1962 | Baron | 222/386.5 X |
| 3,178,075 | 4/1965 | Riedl et al. | 222/386.5 |
| 3,241,726 | 3/1966 | Chester | 222/211 |
| 3,417,901 | 12/1968 | Sands | 222/386.5 X |

*Primary Examiner*—Robert B. Reeves
*Assistant Examiner*—Larry H. Martin
*Attorney, Agent, or Firm*—Brisebois & Kruger

[57] ABSTRACT

Container holding fluid to be dispensed if pressurized by rupturing cartridge containing liquefied gas located within flexible pouch inside the container, preferably by heating the container.

8 Claims, 9 Drawing Figures

PRESSURIZABLE CONTAINER BY HEAT ACTIVATION

SUMMARY OF THE INVENTION

It is well known that in containers for holding under pressure a fluid which is to be dispensed in paste, liquid or aerosol form, the fluid to be dispensed is generally placed under pressure at the moment of use by pressure of a propellant. It is obvious that for reasons of safety, quality and uniformity of the fluid to be dispensed that it is necessary to avoid, in all cases, that is to say both before and during use, contact between the propellant and the fluid to be dispensed. For this purpose, it has already been suggested that a container be used comprising a piston delimiting within said container two chambers, an upper chamber filled with fluid to be dispensed, and a lower chamber filled with the propellant. The propellant exerts on the lower face of the piston an upward pessure intended to dispense the fluid through a valve with which the container is equipped by reducing the volume of the upper chamber. It is obvious that this solution substantially complicates the manufacture of the container since it requires the use of accessories the dimensions of which, relative to the interior dimensions of the container, must be very accurate, so as to insure a perfect seal between the two chambers and still permit the piston to slide within the container. The cost of such a container is thus relatively great and often out of proportion to that of the fluid to be dispensed, the price and quality of which are not always very great.

It has already been suggested that an inner container inflated by the propellant product be slid into a container which holds the product to be dispensed, said inner container being subsequently compressed by the introduction into the outer container of the product to be dispensed under pressure. However, the disadvantage of this second solution resides in the fact that it is often unreliable in operation because the inner container is not always sufficiently compressed or sufficiently filled with a gas under a pressure adequate to insure dispensing of the fluid surrounding the chamber. Moreover, this second type of container is difficult to make since it requires the introduction of the product to be dispensed under a high pressure so as to insure almost complete compression of the inner container.

It is the purpose of the present invention to provide a new pressurized container capable of dispensing a fluid in paste, liquid or aerosol form which has no internal mechanical device while being absolutely safe in operation. The container according to the invention does not comprise any supplemental mechanical accessory so that it is clear that it may be very cheaply manufactured.

It is the object of the present invention to provide a new method of storing under pressure a liquid which is to be distributed in paste, liquid or aerosol form, characterized by the fact that there is introduced into the outer jacket of the container, while open at one of its ends, preferably before introduction of the fluid to be dispensed, a flexible pouch which is gas-tight, hermetically sealed, and which contains a closed cartridge filled with a propellant in the liquid state. The open end of the container is then closed and the closed container equipped with at least one valve permitting the dispensing of the stored fluid. After filling the container with the fluid to be dispensed, the cartridge is at least partially opened, the propellant is converted to its gaseous state so that it expands to fill the entire free inner volume of the pouch at a pressure adapted to eject the fluid surrounding the pouch through the valve with which the container is equipped.

In a preferred embodiment of the invention the cartridge is opened by heating the fluid container, and consequently the pouch therewithin, to a temperature sufficient to open the cartridge by reason of the increase in the inner pressure of the propellant inside it. The flexible pouch slides inside the container and is applied against the inner surface of the lateral wall of the container so that the fluid to be dispensed occupies the free central part of the container.

It is a further object of the present invention to provide as a new article of manufacture a container for storing under pressure a fluid which is to be distributed in paste, liquid or aerosol form characterized by the fact that it comprises, within an outer container equipped with at least one valve permitting dispensing of the stored fluid, a separate flexible gas-tight pouch which is hermetically sealed and which contains a cartridge initially closed and filled with a propellant in a liquid state, so that the opening of this cartridge causes the at least partial gasification of the propellant product, which then expands to fill the entire free internal volume within the pouch at a pressure adapted to insure ejection of the fluid surrounding the pouch through the valve with which the container is equipped.

In a preferred embodiment of this container the free internal volume of the flexible independent pouch, if fully inflated, would be greater than the inner volume of the outer container. The pouch is made of a product which is inert with respect to the fluid to be dispensed and inert with respect to the propellant. The propellant gas used is butane or a chlorofluorinated hydrocarbon such as those sold under the trademark FREON. The cartridge filled with the propellant in the liquid state is either a tube initially closed by a plug, said plug being released from the opening in the tube in response to an increase in the internal pressure exerted by the propellant due to heating of the container, or a section of rubber tubing, for example, which is itself hermetically sealed before being slid into the flexible pouch, the increase in the internal pressure of the propellant due to heating of the container being sufficient to permit the explosion of said tube and consequently the gasification of the propellant when the latter expands to fill the entire internal free space within the pouch. The gaseous propellant filling the flexible pouch is under a pressure of 1 to 10 bars. The container is equipped with a descending tube, one end of which is connected to the dispensing valve while the other end opens substantially in the plane in the bottom of the container, said descending tube also comprising, slightly spaced from its zone of attachment to the valve, at least one supplementary opening permitting circulation of the fluid to be dispensed.

In order that the subject matter of the invention may be better understood, a preferred embodiment thereof will now be described purely by way of illustration and example, with reference to the accompanying drawings, on which:

Figure 1:
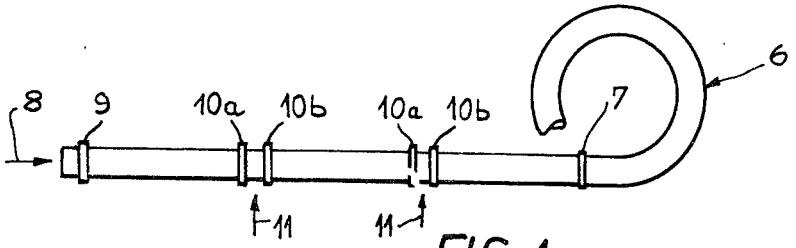
FIG. 1 is a schematic view illustrating a method of manufacturing the cartridge initially filled with the propellant product, said cartridge being in the form of a section of rubber tube.
Figure 2:
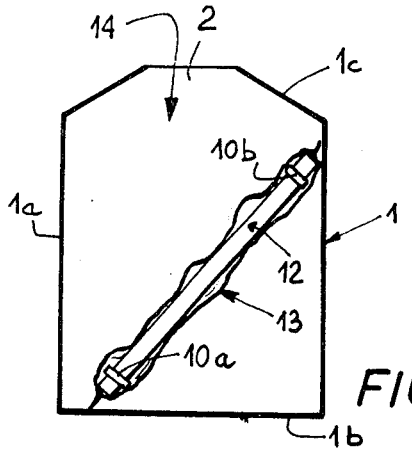
FIG. 2 shows in schematic section a container according to the invention, after introduction of the flexible pouch containing the cartridge holding a propellant and before introduction of the fluid to be dispensed.

Referring now to the attached drawings, and especially to FIGS. 2 to 6, it will be seen that reference numeral 1 indicates the outer jacket of the container as a whole. This jacket has a generally cylindrical form, and comprises a lateral wall 1*a* fixed to a base 1*b* by crimping, for example. The upper part 1*c* of the outer jacket has been shaped into a conical form. The upper end of this upper part is provided with an opening 2 which, at least after introduction of the propellant, is closed by means of a support 3 inserted in the open upper end of the part 1*c* of the jacket 1, said support carrying in its central zone a valve 5 adapted to at least dispense the stored fluid, and if necessary to permit the introduction of this fluid into the container.

In order to manufacture the container according to the invention, the first step is to manufacture the cartridge filled with the propellant in the liquid state.

In a first (unillustrated) embodiment this cartridge is a tube provided with an end which, after filling with the propellant product in the liquid state is hermetically sealed by a plug. In the second embodiment schematically represented in FIG. 1, for illustration of the following description, the cartridge comprises a section of tubing, made of rubber for example. To this end a tube 6 several meters in length is closed near one of its two ends, by means of a ligature 7 and then in a second step the tube is filled, as schematically indicated by the arrow 8, with the propellant in the liquid state. The tube is then ligatured at 9 at its second end and from point to point at regular distances it is divided into a plurality of sections by means of pairs of gripping collars 10*a* and 10*b* to narrowly pinch the tube 6 into two separated zones. The tube is then cut into sections as schematically indicated by the arrow 11 substantially along the median lines separating two adjacent collars 10*a* and 10*b* so that a plurality of sections of rubber tubing is obtained, each having a length of about 10 centimeters and filled with a propellant in the liquid state and closed at its two ends.

Each cartridge, whether a rubber tube 12, manufactured in this manner, or a metallic tube, for example, closed with a plug, is introduced into the inside of a flexible pouch 13 made of a gas-tight material, polyethylene for example. Pouch 13 is then sealed so that it defines a hermetically sealed chamber within which the cartridge is located.

During the step of closing the flexible pouch a partial vacuum may be provided therewithin, or the pouch may be compressed or deformed simultaneously so that the air trapped within the pouch after closing of the latter is at a pressure preferably lower than atmospheric pressure.

The hermetically sealed pouch 13 is then introduced into the outer jacket 1 of the container through the opening 2. The pouch is absolutely separate from, that is to say, not attached to the container, or any of its accessories, such as support 3 or valve 5. The pouch may be introduced in any way into a container of any shape after introduction of the fluid to be dispensed, or at the same time as the fluid to be dispensed, or preferably before such introduction for reasons of ease of manipulation. One should nevertheless take care to introduce into a container having a predetermined internal volume a flexible pouch which, once totally inflated, is capable of occupying a volume greater than the internal volume of the container so that the inflated pouch has a tendency to occupy the entire space within the container and thus facilitate the evacuation of the fluid to be dispensed.

For a container having an internal volume of 200 cubic centimeters for example, a flexible pouch is introduced which, when inflated, will occupy a volume of the order of 250 to 300 cubic centimeters.

Figure 8:
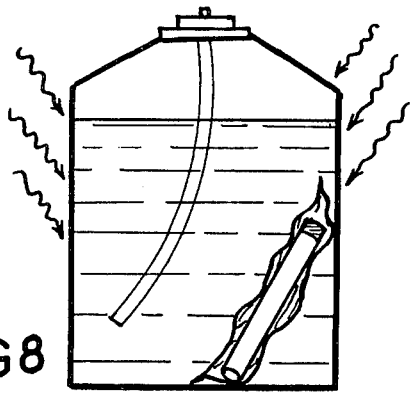
FIG. 8 is a schematic elevational view of a container according to the invention in which the cartridge within the pouch is a tube closed by a plug adapted to be ejected when the container is sufficiently heated.
Figure 9:
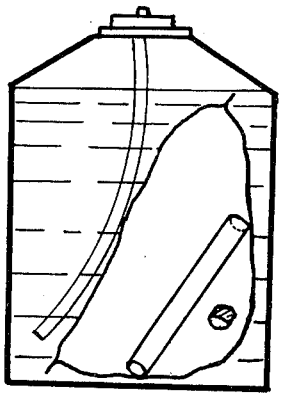
FIG. 9 is a schematic elevational view of the embodiment of FIG. 8, showing the plug ejected and the pouch expanded.

In the embodiment of FIGS. 8 and 9 the cartridge is a tube 12, enclosed in a flexible pouch 13, as in the case of the previously described embodiments, but the tube is closed by a plug 20 adapted to be ejected when the container is heated so as to expand the contents of the tube.

A tube made of natural rubber, nitrile rubber, or polychloroprene is located inside this pouch. The tube may be 15 centimeters in length, 5 millimeters in inner diameter and 6 millimeters in outer diameter, the inner volume of the tube between the two collars 10*a* and 10*b* being therefore of the order of 3 cubic centimeters.

The liquid propellant occupying this space of 3 cubic centimeters is butane or a chlorofluorinated hydrocarbon such as those sold under the trademark FREON.

This pouch 13 is slid into the container 1, preferably before introduction of the fluid to be dispensed. The pouch is introduced through the opening 2, as schematically indicated by the arrow 14, without taking any particular precautions (embodiment of FIG. 2) or preferably introduced and applied against the internal surface of the lateral wall 1*a* of the container, as illustrated in solid lines in FIG. 7.

Figure 3:
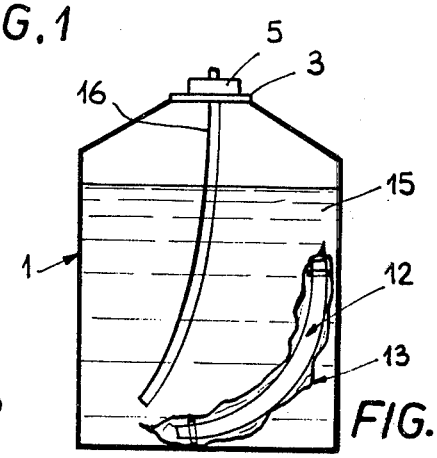
FIG. 3 shows in schematic section the container of FIG. 2 after introduction of the fluid to be dispensed and before closing of the open end of the container.
Figure 4:
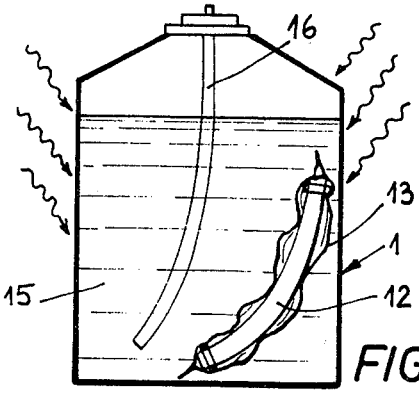
FIG. 4 shows in schematic section the container according to the invention after it has been heated to open or explode the cartridge of propellant without damaging the flexible pouch containing said cartridge.
Figure 5:
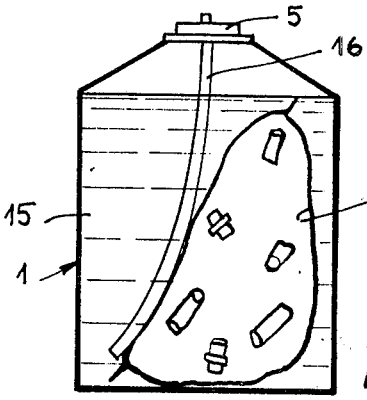
FIG. 5 shows in schematic section a container after explosion of the cartridge and at least partial gasification of the propellant, which expands to fill the entire available space within the flexible pouch.

The product 15 which is to be dispensed is then introduced into the container 1 either directly through the opening 2, the container being then closed in a subsequent step by means of the support 3 and the valve 5, or through this valve 5 after the latter has already been mounted on the container by means of its support 3 (FIG. 3).

The container 1 manufactured in this way is in all cases closed at its upper end. It contains the fluid 15 to be dispensed surrounding the pouch 13, inside which the cartridge 12 is located. In the particular case illustrated in FIG. 7, the fluid 15 has a tendency to occupy the entire free central part of the container 1, but a certain fraction may naturally flow between the internal surface of the lateral wall 1*a* and the outer edges 13*a* of the pouch.

The cartridge 12 is then opened from outside the container, preferably by heating the container to a temperature sufficient to cause opening of said cartridge (FIG. 4), due to the increase in the pressure therewithin. In the foregoing example, this heating temperature must be of the order of 45°C, which temperature results in explosion of the tube 12 (FIG. 5) or in release of the plug in the opening of a metallic tube initially blocked thereby. It is nevertheless obvious that cartridge 12 may be opened in any other conventional manner by complete elimination of the tube 13 at the end of a lapse of time which may be predetermined in advance, by dissolving it in a solvent initially introduced into the flexible pouch, for example.

After opening of the cartridge the propellant is then at least partially gaseous and consequently has a tendency to occupy the entire free internal space within the pouch 13. It is obvious that the quantity of the liquid propellant introduced into a section of tubing must be so calculated that the gaseous quantity which corresponds thereto is under a pressure of the order of 1 to 10 bars, which pressure is sufficient to insure the ejection of the fluid 15 surrounding the pouch 13 through the valve 5 with which the container 1 is equipped. As the fluid 15 is dispensed in response to the internal pressure exerted by the propellant, the flexible pouch has a tendency to deform and occupy the entire internal volume of the container 1 until the stored fluid is completely distributed.

Figure 7:
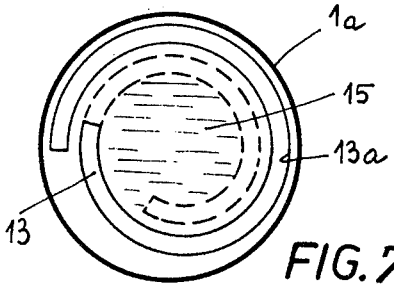
FIG. 7 is a schematic elevational view of the container according to the invention after introduction of a flexible pouch which is applied closely against the internal surface of the lateral wall of the container so that the fluid to be dispensed which will be introduced in a subsequent step will occupy the open central portion of the container.
Figure 6:
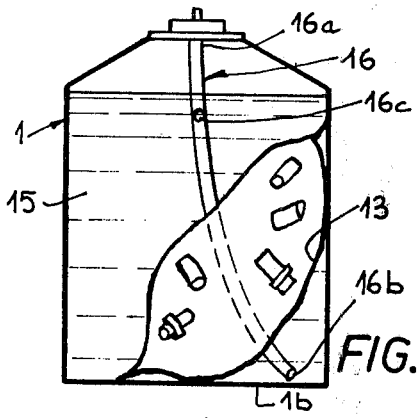
FIG. 6 shows in schematic section the container according to the invention equipped with a descending tube intended to permit the dispensing of all the fluid stored without leaving any part of this fluid trapped in the container at the end of the dispensing step between the flexible inflated pouch and the inner wall of the container.

In the particular case of the embodiment of FIG. 7, the flexible pouch 13 deforms and elongates to form a spiral moving toward the center of the container and occupying the entire free space left by the product dispensed through the valve 5. The spiral deformation of the flexible pouch is illustrated in broken lines on FIG. 7. To prevent a certain quantity of the fluid stored from being trapped between the wall of the container and the flexible inflated pouch as it occupies a volume which is greater and greater inside the container, it is advantageous to equip said container with a depending tube 16, one end 16*a* of which is connected to the dispensing valve and the other end of which opens just above the bottom 1*b* of the container, said depending tube comprising also, slightly below its zone of attachment to the valve, at least one supplementary opening 16*c* so that the fluid to be dispensed may circulate freely in any case through the openings 16*b* and 16*c* to the dispensing valve without any volume of fluid 15 being retained beneath the inflated pouch 13 so as to be unable to reach the dispensing valve. It will of course be appreciated that the embodiments described have been given purely by way of illustration and example and may be modified as to detail without thereby departing from the basic principles of the invention as defined by the following claims.

What is claimed is:

1. Container for holding a fluid under pressure which comprises an outer jacket equipped with at least one valve for dispensing the stored fluid, a flexible separate gas-tight hermetically sealed pouch within said jacket, a cartridge within said pouch which is capable of sustaining only a predetermined internal pressure therewithin, said cartridge being initially closed and filled with a propellant which is in liquid form at said predetermined pressure but is gaseous at room temperature and atmospheric pressure, said propellant being expansible in response to the application of heat so as to produce a pressure within said cartridge above said predetermined pressure which causes the release of said propellant from said cartridge and results in at least partial gasification of said propellant which then expands said pouch to fill the entire free internal space within the pouch under a pressure sufficient to eject the fluid in said jacket through the valve on the container when said valve is opened.

2. Container as claimed in claim 1 in which the internal pouch is capable of expansion to contain a volume greater than the inner volume of said jacket.

3. Container as claimed in claim 1 in which the pouch is made of a product which is inert to the fluid to be dispensed and to the propellant.

4. Container as claimed in claim 1 in which the propellant used is selected from the group consisting of butane chlorofluorinated hydrocarbons.

5. Container as claimed in claim 1 in which said cartridge is a tube initially closed by a plug, adapted to be ejected from said tube when said container is heated sufficiently to increase the internal pressure of the propellant beyond a predetermined point.

6. Container as claimed in claim 1 in which the cartridge is a section of resilient tubing which is itself hermetically sealed, and adapted to rupture when said container is heated sufficiently to increase the internal pressure of the propellant beyond a predetermined point.

7. Container as claimed in claim 1 in which the gaseous propellant filling the flexible pouch is under a pressure of substantially 1 to 10 bars.

8. Container as claimed in claim 1 which is equipped with a descending tube, one end of which is connected to the dispensing valve and the other end of which opens just above the bottom of the container, said descending tube also comprising, slightly below its point of attachment to the valve, at least one supplementary opening permitting the circulation of the fluid to be dispensed therethrough.

* * * * *